US005176423A

United States Patent [19]

Austin, Jr. et al.

[11] Patent Number: 5,176,423

[45] Date of Patent: Jan. 5, 1993

[54] APPARATUS FOR SECURING AN INSTRUMENT HOLDER TO A DENTAL CHAIR

[75] Inventors: George K. Austin, Jr., Newberg; Bradley A. Rice, Salem, both of Oreg.

[73] Assignee: A-Dec, Inc., Newberg, Oreg.

[21] Appl. No.: 693,533

[22] Filed: Apr. 30, 1991

[51] Int. Cl.[5] ..... A61G 15/10

[52] U.S. Cl. ..... 297/191; 297/163

[58] Field of Search ..... 297/146, 163, 167, 169, 297/191, 411, 417; 248/280.1, 281.1

[56] References Cited

U.S. PATENT DOCUMENTS

| | | | |
|---|---|---|---|
| 513,735 | 1/1894 | Russell . | |
| 1,929,471 | 4/1933 | Bank . | |
| 3,813,147 | 5/1974 | Rick | 297/191 |
| 4,141,586 | 2/1979 | Goldner et al. | 297/191 |
| 4,351,562 | 9/1982 | Twitchell et al. . | |
| 4,630,862 | 12/1986 | Watanabe | 297/191 X |
| 4,883,316 | 11/1989 | Austin, Jr. et al. | 297/191 |
| 4,886,317 | 12/1989 | Konzmann et al. | 297/417 |
| 4,968,095 | 11/1990 | Moyer | 297/417 |
| 4,978,170 | 12/1990 | Pelz et al. | 297/411 |

FOREIGN PATENT DOCUMENTS

| | | |
|---|---|---|
| 310355 | 4/1989 | European Pat. Off. . |
| 2157291 | 1/1973 | Fed. Rep. of Germany . |
| 3038822A1 | 4/1981 | Fed. Rep. of Germany . |

OTHER PUBLICATIONS

Brochure, "2 New Options For A-Dec's Priority Chair", A-Dec, Inc., 1987, 2 pages.

*Primary Examiner*—Brown, Peter R.
*Attorney, Agent, or Firm*—Klarquist, Sparkman, Campbell, Leigh & Whinston

[57] ABSTRACT

The apparatus secures a dental instrument holder to the movable backrest of a dental chair. The apparatus maintains a preselected orientation of the holder irrespective of movement of the backrest.

14 Claims, 3 Drawing Sheets

61
66
68
72
74
67
65
63
58
60
28
30
32
52
54
36
38
48
34
102
104
100
40
42
44
26
24
92
99
88
94
97
86
22
84
23
72
67
79
75
77
74
20
82
66
71
58
60
62
46

APPARATUS FOR SECURING AN INSTRUMENT HOLDER TO A DENTAL CHAIR

TECHNICAL FIELD

This invention relates to an apparatus for securing a dental instrument holder to the movable backrest of a dental chair.

BACKGROUND INFORMATION

In the practice of dentistry, it is important to have the necessary dental instruments held in a convenient and accessible location. To facilitate easy access to the instruments, it is desireable to have the instrument holder attached to the dental chair backrest in such a way that the holder maintains a desired orientation even though the dental chair backrest may be moved.

Various mechanism have been designed to attach instrument holders to a dental chair. U.S. Pat. No. 4,883,316 to Austin, Jr., et al., herein incorporated by reference, discloses a mechanism having the capability of maintaining an instrument holder in a desired orientation irrespective of movement of the dental chair backrest. That patent describes an instrument holder that is mounted to the backrest by an attachment member that can pivot relative to the backrest. The attachment member is normally held stationary by a cable that extends from the attachment member to the chair seat. The instruments hang generally vertically from the instrument holder. When the chair backrest is tilted from an upright position, the cable tightens to pivot the attachment member so that the instrument holder maintains the orientation for hanging the instruments vertically. A spring is connected to the attachment member and is stretched when the backrest is tilted. When the backrest is moved back toward the upright position, the cable loosens and the stretched spring pulls the attachment member so it pivots back toward its original position, thereby maintaining the instrument holder in the same orientation mentioned above.

The above mentioned spring also serves as a safety mechanism. In this regard, whenever the instrument holder encounters a solid object as the backrest is moved from the upright position, the attachment member is free to rotate against the tension in the spring so that the downward motion of the instrument holder is effectively stopped, thereby preventing damage to the instrument holder.

A second spring is provided for anchoring the cable to the chair seat in a manner such that the second spring will compress in the event the instrument holder encounters a solid object as the chair moves toward the upright position. Accordingly, the second spring prevents damage to the instrument holder by effectively stopping the upward motion of the instrument holder.

The cable and spring mechanism just described also includes adjustment mechanisms for increasing the tension in the cable after the cable becomes stretched due to repeated use.

SUMMARY OF INVENTION

This invention is directed to a compact and reliable apparatus for securing an instrument holder to a dental chair. The apparatus requires no periodic adjustment and includes a safety mechanism for preventing damage to the holder or instruments in the event a solid object is encountered as the backrest is moved between an upright and tilted position.

DETAILED DESCRIPTION OF THE PREFERRED EMBODIMENT

Figure 1:
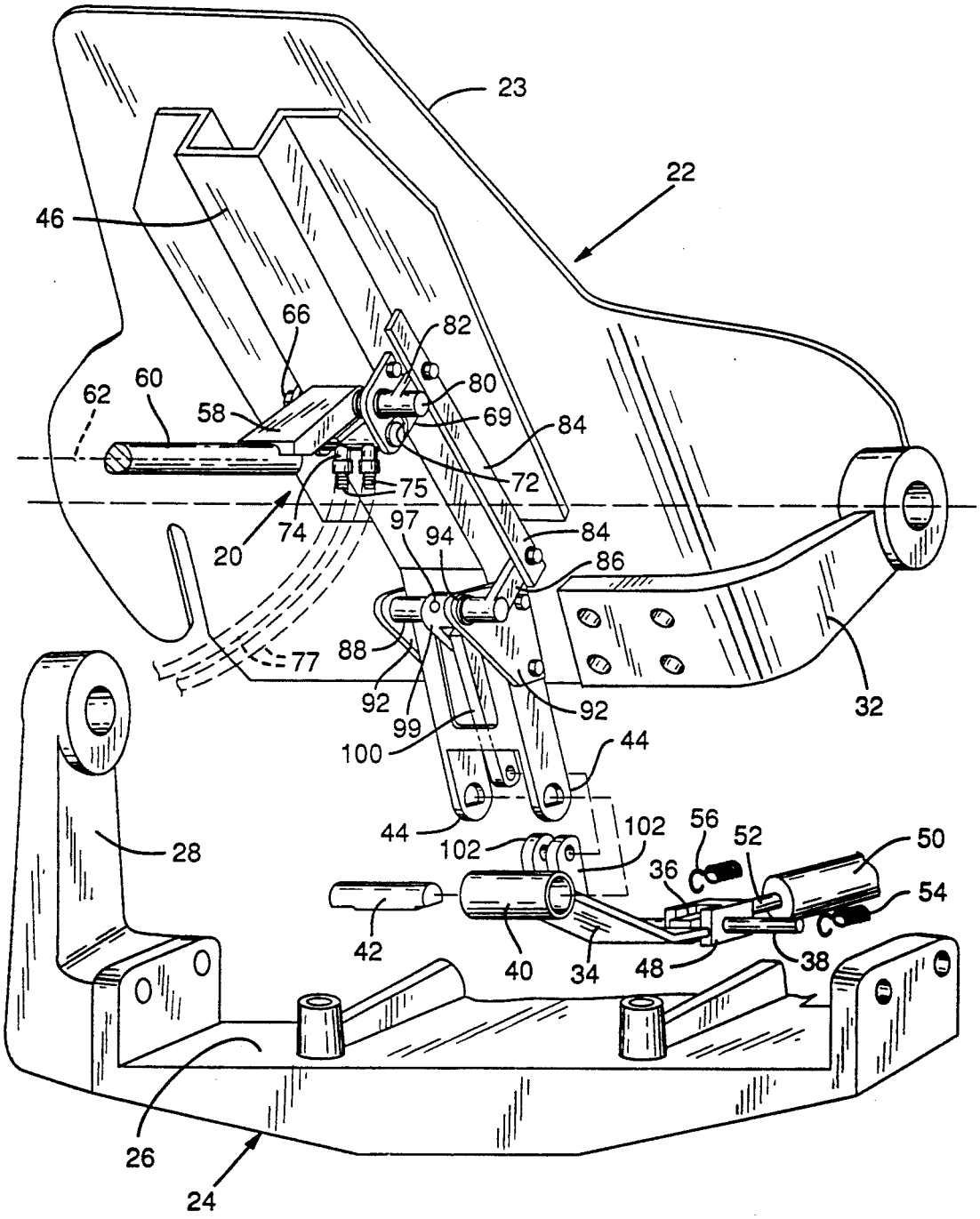
Fig. 1 is a perspective view of an apparatus formed in accordance with the present invention and mounted to a dental chair.
Figure 3:
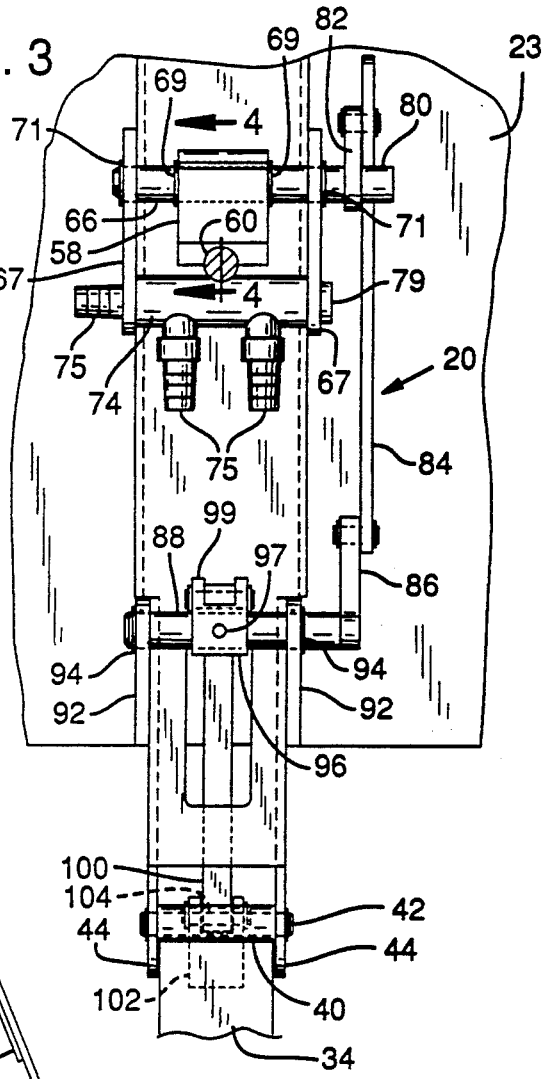
FIG. 3 is a rear elevation view of the apparatus.

With reference to FIG. 1-3, the apparatus 20 of the present invention is fastened to the backrest 22 (shown with cushions removed) of a dental chair such as that described in the U.S. Pat. application No. 07/501,674, herein incorporated by reference.

Figures 2B, 4:
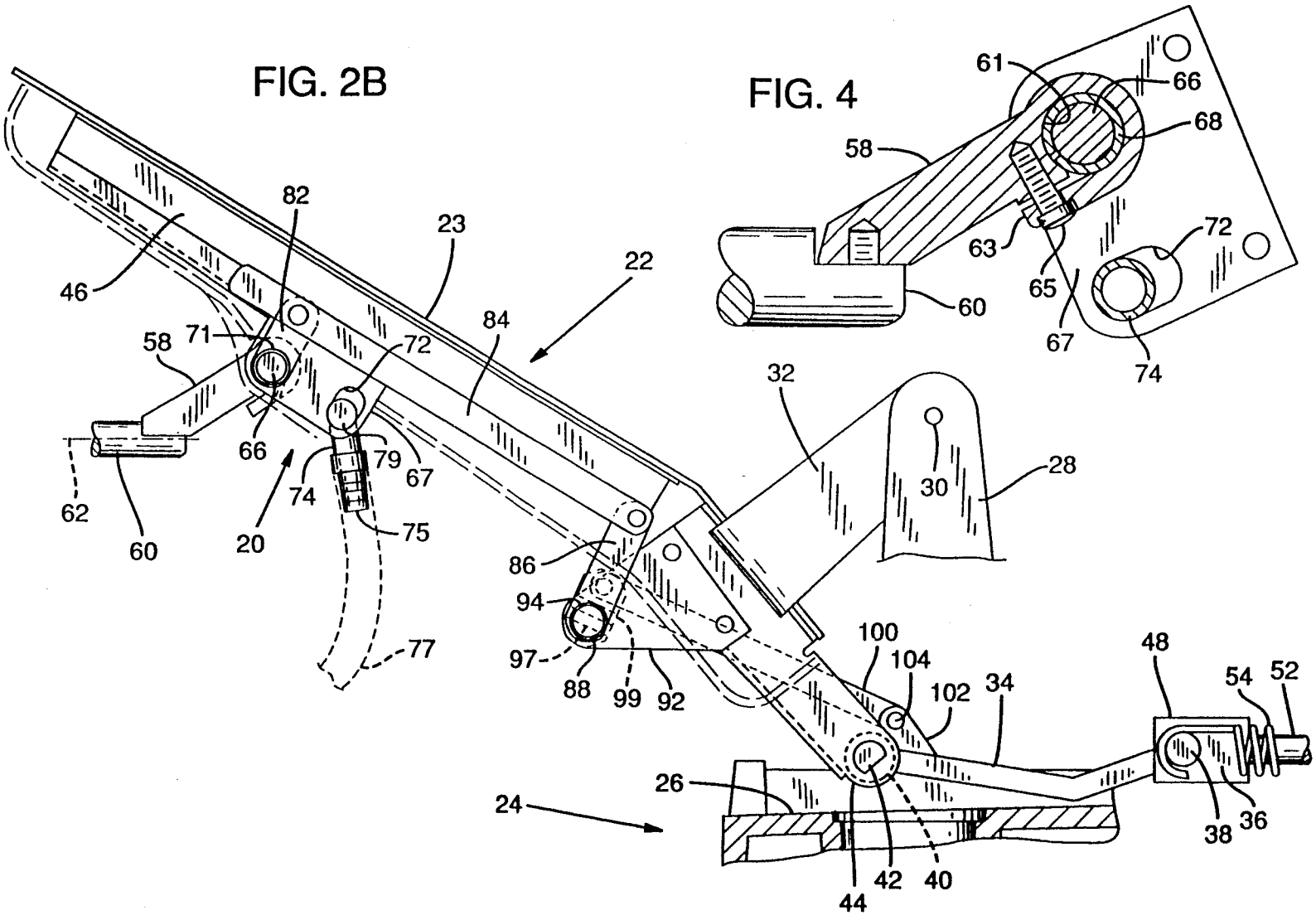
FIG. 2B is a side elevation view showing the apparatus when a dental chair backrest is in the tilted position.
FIG. 4 is an enlarged section view taken along 4—4 of FIG. 3 showing the safety mechanism of the invention.

The dental chair comprises a seat 24, the drawings illustrating only the primary support structure or seat base 26, having an arm support 28 projecting upwardly from each side of the seat base 26. The upper end of the arm support 28 is pivotally attached by a pin 30 (FIGS. 2A-2B) to a rigid back support 32 that is fastened to, and projects forwardly from, the lower portion of the backrest 22. The backrest is driven, as described below, to pivot about the pin 30 between an upright position (FIG. 2A) and a tilted position (FIG. 2B).

One end of a back link 34 is connected to the backrest 22. That end of the back link 34 carries a pivot tube 40 connected thereto for surrounding a pivot pin 42 that is fastened between two tabs 44 that project downwardly from the lower end of a channel bracket 46 that is fastened to the plate 23 of the backrest 22.

The back link 34 is a generally flat bar having a bend of approximately 20° near the end distant from the backrest 22. A pivot block 36 (FIG. 1) is attached to that end of the link 34. The pivot block 36 includes a hole through which extends an elongated drive rod 38. As described in more detail below, the rod 38 is driven forwardly (that is, to the right in FIGS. 2A and 2B) and rearwardly (that is, to the left in FIGS. 2A and 2B) for moving the backrest 22 relative to the seat 24.

Figure 2A:
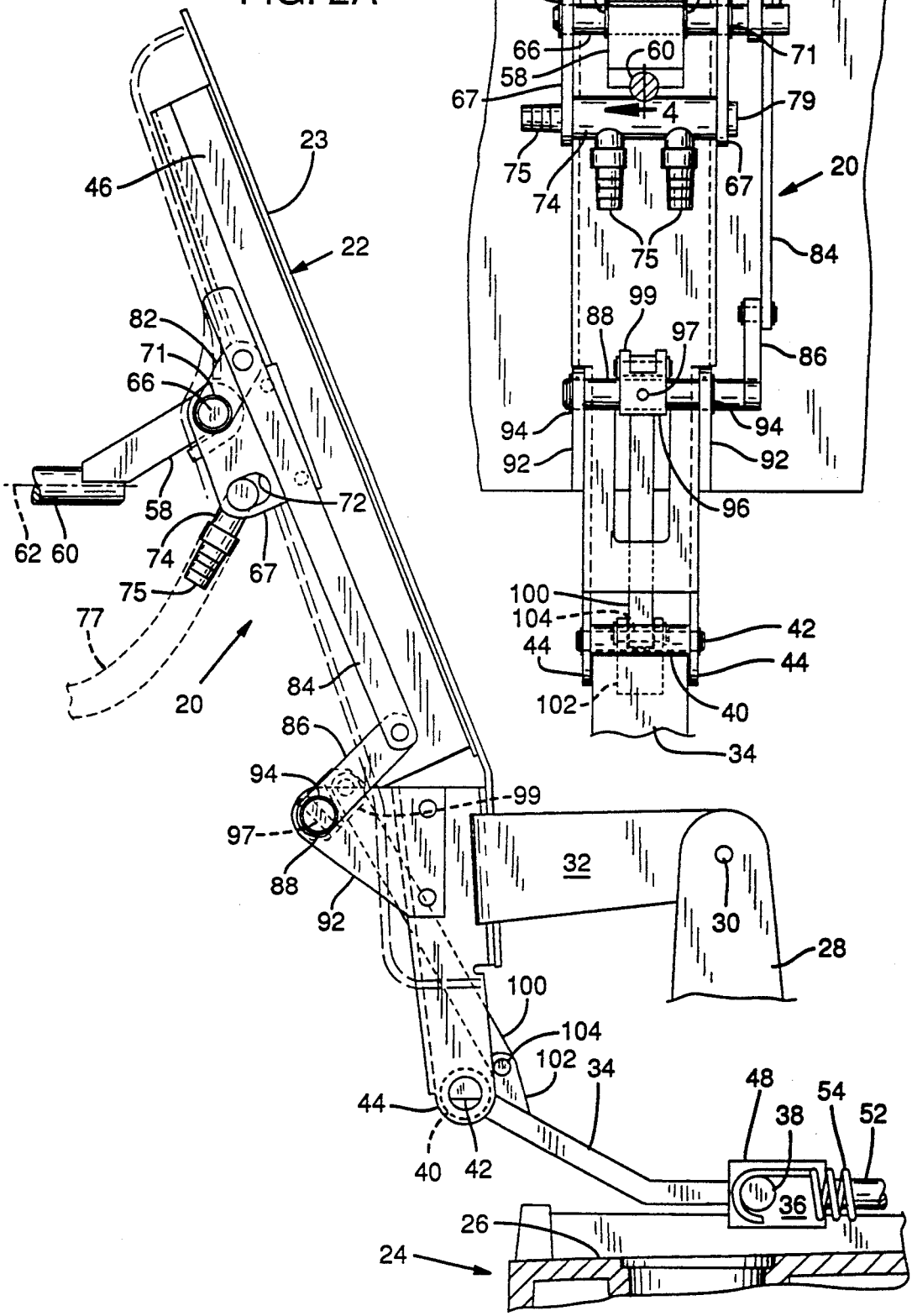
FIG. 2A is a side elevation view showing the apparatus when the dental chair backrest is in the upright position.

The drive rod 38 is connected by a clevis 48 to the rod end of a hydraulic actuator 50. The actuator 50 is mounted to the seat base 26 and is hydraulically driven for extending its piston rod 52 so that the connected drive rod 38 moves rearwardly, to the left in FIG. 2A, thereby causing the backrest to pivot via pin 30 to the upright position (FIG. 2A).

When the hydraulic pressure is released from the actuator 50, the drive rod 38 is pulled by two tension springs 54, which are connected between the ends of the drive rod 38 and the seat base 26, toward the right in FIG. 2B, thereby pulling the backrest toward the tilted position (FIG. 2B). Any suitable system for controlling the actuator may be employed, such as that described in the referenced U.S. Pat. application No. 07/501,674.

The apparatus 20 of the present invention is connected to the back link 34 and backrest 22 so that movement of the backrest 22, as just described, also drives the moving parts of the apparatus 20. More particularly, as the backrest 22 is moved between the tilted and upright position relative to the seat 24, the attachment apparatus 20 serves to maintain a preselected orientation for an attached dental instrument holder 60, irrespective of the backrest position For clarity, only a small portion of an instrument holder 60 is depicted in the figures. The instrument holder may be constructed, such as that depicted in the above referenced U.S. Pat. No. 4,883,316, for holding dental instruments that are supplied with water, air, and vacuum.

In the preferred embodiment of the apparatus 20 of the present invention, the portion of the instrument holder 60 that attaches to the apparatus 20 is held so that its central axis remains in the generally horizontal plane shown by line 62 irrespective of movement of the backrest 22 between the upright and tilted positions. Such an orientation of the instrument holder 60 permits the instruments to be hung therefrom in a generally vertical orientation. As described below, the user of the apparatus 20 may select (and the apparatus will maintain) any preferred orientation of the instrument holder 60, including the horizontal orientation depicted in the figures.

Turning now to the particulars of the apparatus 20, and with reference to FIGS. 3 and 4, one end of an attachment arm 58 is fastened to the instrument holder 60. The opposite end of the arm 58 is formed to have reduced thickness and is bent into a smooth curve, thereby defining an aperture 61. The terminus 63 of the reduced thickness end of the attachment arm 58 extends adjacent to the remaining part of the arm and is fastened thereto by a screw 65. The screw 65 may be tightened or loosened to decrease or increase, respectively, the diameter of the aperture 61, thereby permitting changes to the amount of clamping force applied by the attachment arm to the pivot pin 66, as described below.

A pivot pin 66 extends through the aperture 61 in the arm 58. The central portion of the pivot pin 66 resides within the aperture 61 and is surrounded with a longitudinally split, oil-impregnated, bronze brushing 68. The bushing 68 is held in place on the length of the pin 66 by two spaced-apart clips 69 (FIG. 3) that snap into grooves formed in the pin 66, one groove near each end of the aperture 61.

The pin 66 is mounted to a pair of bracket plates 67 that are fastened to extend rearwardly from each side of the elongated channel bracket 46 and have holes through which the pin 66 extends. Bushings line the holes to minimize wear between the pin 66 and plates 67 as the pin rotates relative to the plates. The pivot pin 66 has formed in it two grooves spaced apart a distance slightly wider than the distance between the bracket plates 67. Each groove receives a clip 71 that snaps therein for keeping the pin 66 from moving longitudinally out through the bracket plates 67.

The bracket plates 67 include oval-shaped openings 72 for receiving the ends of a manifold 74 that hangs between the bracket plates 67. The manifold 74 includes stubs 75 for receiving fluid tubing, such as shown at 77 (FIGS. 2A–2B), applying suction to an instrument that is carried by the holder 60. The ends of the tubes 77 opposite those connected to the manifold 74 terminate at the instruments carried by the holder 60.

The manifold 74 rotates freely within the openings 72 and is free to slide therein toward and away from the backrest 22. This configuration is useful in the event the arm 58 is inadvertently forced down against the manifold 74 because the manifold is then able to slide against the backrest and be supported along its length by the backrest to resist being broken by the arm 58.

The pivot pin 66 includes an extension 80 (FIG. 3) on one side thereof extending outwardly from the bracket plate 67. One end of an upper crank arm 82 is fixed, as by welding, to the central part of the extension 80. The outer end of the upper crank arm 82 is pinned to the upper end of an elongated rigid link 84. As will be described in more detail below, the link 84 transmits motion for rotating to the pivot pin 66.

The lower end of the link 84 is pinned to a lower crank arm 86 that is fastened to extend from one end of a drive pin 88. The drive pin 88 is pivotally mounted to two spaced-apart brackets 92 that are fastened to the channel bracket 46 beneath the above-described bracket plates 67. As was the pivot pin 66 described above, the drive pin 88 is rotatably mounted within holes defined in the triangular shaped brackets 92. The holes in the brackets 92 are lined with bushings To prevent the drive pin 88 from moving longitudinally from the brackets 92, clips 94 are snapped into grooves in the pin 88 adjacent to each bracket 92.

In the particular apparatus illustrated, a clevis 96 is fixed to the drive pin 88 between the brackets 92. A locking pin 97 is press fit into aligned holes through both the clevis 96 and the drive pin 88, thereby securing the clevis 96 to be irrotatable relative to the pin 88.

The jaws 99 of the clevis 96 are rotatably pinned to the rearward end of a rigid drive link 100. The forward end of that drive link 100 extends between a pair of pivot brackets 102 that are fastened to the back link 34 near the pivot tube 40 mentioned earlier. The drive link 100 is pivotally attached to the pivot brackets 102 by another pivot pin 104.

With reference to FIGS. 2A and 2B, the operation of the apparatus is now described. As the chair moves from the upright position (FIG. 2A), the drive link 34 is pulled forwardly (to the right in FIG. 2A), thereby causing the backrest 22 to pivot counterclockwise about pivot pin 30. As the backrest 22 rotates about pin 30 through an angle of, for example, 30° , into the tilted position, FIG. 2B, tension is developed in drive link 100, which tension is transmitted to the lower crank arm 86 causing that arm to rotate clockwise about the drive pin 88. The rotational movement of the lower crank arm 86 is transferred directly via link 84 to the upper crank arm 82, thereby causing clockwise rotational movement of the upper crank arm about the rotational axis of the pivot pin 66.

The attachment arm 58, tightened as it is to the pivot pin 66, rotates in the clockwise sense with the pin 66. The linkage assembly is configured so that the amount of angular rotation imparted in the pivot pin 66, hence, in the attachment arm 58, substantially equals the amount of rotation, for example, 30° , of the backrest in moving between any two positions. This configuration, therefore, maintains the holder 60 in the selected orientation relative to horizontal (FIGS. 2A and 2B) as the backrest 22 moves.

Whenever the backrest 22 is moved from the tilted position (FIG. 2B) toward the upright position (FIG. 2A), the rearward movement of the back link 34 generates compression in the drive link 100, thereby imparting counterclockwise rotation in the lower crank arm 86 which is transmitted via link 84 to the upper crank arm 82. Consequently, the attachment arm 58 rotates counterclockwise to again maintain the instrument holder 60 in its original orientation relative to horizontal as the backrest 22 moves.

The apparatus 20 is constructed so that the crank arms 82, 86 and link 84 remain on one side of the pivot pin 66 and drive pin 88. More particularly, with reference to FIGS. 2A and 3, stop mechanisms are provided for preventing the link 84 from swinging past (to the left in FIG. 2A) the pivot pin 66. In this regard, the extension 80 of the pivot pin protrudes outwardly (to the right in FIG. 3) further than the link 84 thereby preventing movement of the link 84 over the pin 66 when the crank arm 82 is rotated counterclockwise as the backrest 22 reaches the full upright position.

The link 84 is provided with its own extension 85, which comprises a continuation of the link beyond the location where the crank arm 82 is pinned to the link 84. The extension 85 of the link 84 will abut the extension 80 of the pivot pin 66 when the crank arm 82 is rotated clockwise as the backrest 22 reaches the full tilted position.

In the event the instrument holder 60 or attachment arm 58 encounters a solid object as the backrest is moved between the upright and recumbent positions, the attachment arm 58 will slip around the pivot pin 66 because of the presence of the oil-impregnated split bushing 68 between the arm 58 and pin 66. With reference to FIG. 4, the adjustment screw 65 is tightened to clamp the attachment arm 58 and split bushing 68 to the pin 66 with enough force for preventing the attachment arm 58 from slipping relative to the pin 66 under the weight of the dental instruments and holder 60. The clamping force, however, can be made loose enough to cause the attachment arm to slip about the pin 66 should a solid object be encountered as mentioned above.

The just described slipping or clutch mechanism acts as a safety mechanism to prevent damage to the instruments or holder. Moreover, the position of the attachment arm 58 may be manually forced by the dental technician to slide about the pin 66 if it is desirable to change the orientation of the holder.

While the present invention has been described in accordance with preferred embodiments, it is to be understood that certain substitutions and alterations may be made thereto without departing from the spirit and scope of the appended claims.

We claim:

1. An attachment apparatus for attaching a dental instrument holder to a backrest of a chair that is rotatable between a tilted position and an upright position by extension and retraction of an actuator member, the apparatus comprising:

a first pivot member attachable to the chair for rotation relative thereto;

an arm mounted to the first pivot member for rotation with the first pivot member and adapted for attachment to an instrument holder, the arm assuming a first orientation relative to horizontal when mounted to the first pivot member, the arm being adjustably mounted to the first pivot member to permit forced rotation of the arm relative to the pivot member thereby to change the orientation of the arm relative to horizontal;

a second pivot member attachable to the chair and rotatable in opposing first and second directions;

a linkage assembly connected between the first and second pivot members for transmitting the rotation of the second pivot member to the first pivot member; and a rigid drive link having one end connected to the second pivot member and the other end connectable to the actuator member, the actuator being operable for rotating the second pivot member in the first direction and in the second direction, the linkage assembly being configured and arranged so that the arm member substantially remains in the first orientation irrespective of rotation of the backrest.

2. The apparatus of claim 1 wherein the arm is clamped to the pivot member, the arm including adjustment means for tightening and loosening the clamping force applied to the first pivot member.

3. The apparatus of claim 1 wherein the linkage assembly comprises a first crank arm fastened to the first pivot member and a second crank arm fastened to the second pivot member, and a connector link connected between the first and second crank arms for transmitting rotation between those crank arms.

4. The apparatus of claim 3 further comprising stop means for limiting the amount of movement of the linkage assembly relative to the first and second pivot members.

5. The apparatus of claim 4 wherein the stop means includes an extension part attached to the first pivot member for abutting the connector link to stop rotation of the connected second pivot member in the first direction.

6. The apparatus of claim 4 wherein the stop means includes an extension part attached to the connector link for abutting the first pivot member to stop rotation of the connected second pivot member in the second direction.

7. The apparatus of claim 3 wherein the first and second crank arms are configured and arranged so that the amount of rotation of the first pivot member substantially equals the amount of rotation of the backrest as the backrest moves between the tilted and upright position.

8. The apparatus of claim 1 further comprising brackets for attachment to the backrest, the brackets including holes formed therein for securing the first pivot member, the brackets also having apertures formed therein for receiving a manifold that is mounted for rotation relative to the brackets and constructed to connect with tubes for providing suction to instruments that are held by the holder.

9. An attachment apparatus for a dental chair, comprising:

a seat base;

a backrest connected to the seat base, the backrest being rotatable between a tilted position and an upright position by extension and retraction of an actuator member that is mounted to the chair seat;

a first pivot member attached to the backrest for rotation relative to the backrest;

an arm mounted to the first pivot member for rotation with the first pivot member and adapted for attachment to an instrument holder, the arm assuming a first orientation relative to horizontal when mounted to the first pivot member a second pivot member attachable to the chair backrest and rotatable in opposing first and second directions;

a linkage assembly connected between the first and second pivot members for transmitting the rotation of the second pivot member to the first pivot member; and a rigid drive link having one end connected to the second pivot member and the other end connected to the actuator member so that extension of the actuator member rotates the second pivot member in the first direction and so that retraction of the actuator member rotates the second pivot member in the second direction, the linkage assembly being configured and arranged so that the arm substantially remains in the first orientation irrespective of rotation to the backrest; and brackets attached to the backrest, the brackets having apertures formed therein for receiving a manifold that is constructed to connect with tubes, the manifold being free to rotate relative to the brackets.

10. The apparatus of claim 9 wherein the linkage assembly comprises a first crank arm fastened to the first pivot member and a second crank arm fastened to the second pivot member, and a connector link connected between the first and second crank arms for transmitting rotation between those crank arms.

11. The apparatus of claim 10 further comprising stop means for limiting the amount of movement of the linkage assembly relative to the first and second pivot members.

12. The apparatus of claim 11 wherein the stop means includes an extension part attached to the first pivot member for abutting the connector link to stop rotation of the connected second pivot member in the first direction.

13. The apparatus of claim 11 wherein the stop means includes an extension part attached to the connector link for abutting the first pivot member to stop rotation of the connected second pivot member in the second direction.

14. The apparatus of claim 9 wherein the arm is clamped to the pivot member, the arm including adjustment means for tightening and loosening the clamping force applied to the first pivot member.

* * * * *